United States Patent [19]

Cramer

[11] 4,238,441

[45] Dec. 9, 1980

[54] PROCESS FOR PREPARING ACRYLIC POLYMER PLEXIFILAMENTS

[75] Inventor: Francis B. Cramer, Newark, Del.

[73] Assignee: E. I. Du Pont de Nemours and Company, Wilmington, Del.

[21] Appl. No.: 378

[22] Filed: Dec. 29, 1978

[51] Int. Cl.[3] ..... D01D 5/04

[52] U.S. Cl. ..... 264/206; 260/29.6 AN; 264/211; 525/336; 525/350

[58] Field of Search ..... 264/182, 206; 260/29.6 AN; 526/214, 224; 525/336, 350

[56] References Cited

U.S. PATENT DOCUMENTS

| | | | |
|---|---|---|---|
| 2,434,054 | 1/1948 | Roedel | 526/214 |
| 3,380,949 | 4/1968 | Isley et al. | 260/30.4 |
| 3,448,092 | 6/1969 | Chiang | 260/79.3 |
| 3,819,762 | 6/1974 | Howe | 260/876 R |
| 3,828,013 | 8/1974 | Nield | 260/85.8 R |
| 3,879,360 | 4/1975 | Patvon et al. | 526/224 |
| 3,917,553 | 11/1975 | Thompson | 260/29.6 AN |
| 3,984,601 | 10/1976 | Blickenstaff | 428/364 |
| 4,004,072 | 1/1977 | Tamura | 526/214 |
| 4,094,,948 | 6/1978 | Blickenstaff | 264/206 |

OTHER PUBLICATIONS

Kirby et al., "Macromolecules" L, p. 53–58 (1968).

*Primary Examiner*—Jay H. Woo

[57] ABSTRACT

A process for preparing acrylonitrile polymer plexifilamentary strands comprises dispersing in water 25 to 45% by weight of an acrylic polymer containing at least 91% by weight acrylonitrile units and up to 9% by weight of one or more copolymeric units and having an intrinsic viscosity of 0.6 to 2.0, 7 to 23 μeq./g. enolizable groups after mild acid treatment, 15 to 70 μeq./g. thioether ends derived from a water insoluble mercaptan and less than 3 μeq./g. oxidizable hydrolysis fragments, heating the dispersion to a temperature of 200° to 300° C. while maintaining the dispersion under sufficient pressure to maintain the water in the liquid state, the time of heating not exceeding about 30 minutes, and promptly flash-extruding the dispersion through an orifice into a region of substantially lower temperature and pressure to form a continuous strand of fibrillated plexifilaments.

3 Claims, No Drawings

PROCESS FOR PREPARING ACRYLIC POLYMER PLEXIFILAMENTS

BACKGROUND OF THE INVENTION

The invention relates to an improved process for preparing acrylic plexifilaments by flash extrusion of an aqueous dispersion of an acrylic polymer. The resulting acrylic polymer plexifilamentary strands have improved initial whiteness as well as improved whiteness retention on heating.

U.S. Pat. No. 3,774,387 (Woodell) teaches the preparation of acrylonitrile polymer plexifilamentary strands by extrusion of an aqueous dispersion of acrylonitrile polymer containing 25–40% by weight polymer under particular elevated temperature and pressure conditions. A plexifilament consists of an assembly of fibrils of irregular cross-section which are interconnected at various points to form a plexus. The fibrils tend to lie roughly parallel to the assembly. The fibrils may be thought of as an inter-mingled nonplanar matrix of very thin fiber or ribbon-like elements that are interconnected at various points to form a web-like three dimensional network or plexus.

To maintain uniformity of the Woodell aqueous dispersions, particulate water-insoluble stabilizers, comprising up to 15 percent (preferably 2 to 12 percent) based on weight of the polymer employed, may be used. Such stabilizers include: inorganic oxides, such as aluminum oxide; silicon compounds, such as colloidal silica, aluminum silicate, ethyl orthosilicate; cellulose; and cross-linked vinyl polymers, for example, having sulfonic acid groups. The dispersion may also be mechanically stirred to aid in maintaining uniformity. The dispersion is heated and then extruded at temperatures between about 260° C. and about 280° C. and pressures of between about 50 atmospheres and about 110 atmospheres (~5050–1150 kPa). The pH of the aqueous dispersion is maintained on the acidic side, usually by addition of sulfuric acid, and pH's of between 1.0 and 6.0, depending on the stabilizer present, are most useful. It is generally also useful when processing in batch equipment to hold the dispersion at its extrusion temperature for a short time before extruding, e.g., for about 1 to 5, 10, 15 or even 20 minutes; to assure conversion of all polymer particles to form the hydrate melt; and it is sometimes convenient to raise the temperature in two discrete and separate levels during the heating. Moreover, it is sometime advantageous to employ a pressure let-down region immediately adjacent the extrusion orifice. Excessive exposure of the polymer to high temperature in the presence of water should be avoided, however, since such exposure is adverse to plexifilament whiteness. If desired, a mixture of water and aceonitrile may be employed as the dispersant medium and lower extrusion temperatures (e.g., 220° C.) may be used.

Use of particulate, water-insoluble stabilizers is disadvantageous but necessary when shaping a dispersion of polymer prepared in the usual way as a particulate slurry. Use of high temperatures in the presence of water gives rise to discoloration and hydrolysis of the acrylonitrile polymers known in the art.

Polymers for the preparation of acrylic fibers, which by definition contain 85% or more by weight acrylonitrile, are ordinarily prepared as an aqueous slurry using redox catalysts, e.g., potassium persulfate initiator and sodium bisulfite activator. In fiber form, these polymers have the disadvantage of being somewhat off-white in color as formed and discolor even further on heating at high temperatures. It is known that initial yellowness (lack of whiteness) and the tendency to discolor further on heating of the acrylic polymers is inversely related to the polymer molecular weight. Therefore, manufacturing practice has been to adjust polymer molecular weight to that required to provide fibers of acceptable whiteness. The use of higher molecular weight polymer than is needed to provide adequate fiber physical properties results in a loss of productivity since the solutions used in processing such polymers have higher viscosities than would otherwise be needed.

While the source of yellowness in acrylonitrile polymers and fibers prepared therefrom is not completely understood, it is now generally accepted that the color is due to a chromophoric structure consisting of a series of condensed naphthyridine rings each bearing a

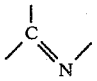

residue, several of which in an unbroken series absorb in the ultraviolet region of the spectrum, rendering the polymer yellow.

One method proposed for blocking formation of this chromophore is to prepare copolymers wherein the acrylonitrile units are separated by copolymeric units sufficiently often to prevent aggregation of the six or seven consecutive acrylonitrile units required for color formation. While effective, this method is generally not useful in the case of fibers because the amount of comonomer required, e.g., about 21% by weight in the case of methyl acrylate, is not conducive to good fiber properties, especially with respect to dimensional stability. Bulky comonomers are more effective on a weight percent basis in preventing formation of the chromophore but are equally disadvantages with respect to dimensional stability. For example, as little as 10.5 weight percent styrene copolymerized with 89.5% by weight acrylonitrile results in significant shrinkage of fibers prepared therefrom under the hot-wet conditions encountered in commercial dyeing and laundering. Most commercial acrylic fibers contain no more than 9% by weight comonomer(s).

It has recently been proposed by Brandrup, Peebles et al., *Makromol. Chem.*, 98, 189 (1966) and *Macromolecules*, 1, 53–8 (1968) that the naphthyridine chromophores are formed from $\beta$-ketonitrile groups derived from an adduct formed by free radical attack on the nitrile group in the polymer. U.S. Pat. No. 3,448,092 (Chiang) describes a polymerization process using coordination catalysts which provides acrylonitrile polymers having less than 5 $\mu$eq./g. $\beta$-ketonitrile groups. These polymers have improved stability to discoloration on heating. However, this process is disadvantageous because nonaqueous solvents must be used.

U.S. Pat. No. 3,828,013 (Nield) describes an emulsion polymerization process for preparing acrylonitrile polymers containing up to 95 mol percent acrylonitrile (90.6% acrylonitrile by weight when copolymerized with styrene) using a combination of low volatility and high volatility mercaptans as chain transfer agents to control molecular weight. Although primarily intended for the molding of bottles, the polymers are also said to be suitable for the preparation of fibers. Color stability of the polymers on heating is not mentioned.

Another emulsion polymerization process for the preparation of acrylonitrile polymers is described in U.S. Pat. No. 3,819,762 (Howe). Dodecyl mercaptan is used as a chain transfer agent in some of the examples but is not required by the claims. The resulting polymers containing up to 85% by weight acrylonitrile are suitable for molding into bottles. No suggestion is made that the polymers are suitable for the spinning of fibers.

The present invention provides an improved process for the preparation of acrylic polymer plexifilaments having the process advantages of reduced sensitivity to discoloration and hydrolysis of the polymer due to process interruptions, elimination of the need to use particulate, water-insoluble stabilizers and elimination of the need to isolate the polymer from its preparation mixture. The resulting plexifilaments have improved initial whiteness and improved whiteness retention on heating.

This invention provides an improved process for producing plexifilament strands of an acrylontrile polymer which comprises dispersing in water 25 to 45% by weight of an acrylonitrile polymer containing at least 91% by weight acrylonitrile units and up to 9% by weight copolymeric units having an intrinsic viscosity of 0.6 to 2.0, 7 to 23 μeq./g. enolizable groups after mild acid treatment, 15 to 70 μeq./g. thioether ends derived from a water insoluble mercaptan and less than 3μ eq./g. oxidizable hydrolysis fragments, heating the dispersion to a temperature of 200° to 300° C. while maintaining the dispersion under sufficient pressure to maintain the water in the liquid state, the time of such heating not exceeding about 30 minutes, and promptly flash-extruding the dispersion through an orifice into a region of substantially lower temperature and pressure to form a continuous strand of fibrillated plexifilaments. Preferably the intrinsic viscosity is 0.8 to 1.5 and most preferably the intrinsic viscosity is 0.9 to 1.1.

Polymer suitable for use in the present invention may be conveniently prepared as an aqueous emulsion using water, the desired monomers, relatively low concentrations of a free radical initiator, a surfactant and a water insoluble mercaptan as chain transfer agent. The resulting latex may be coagulated by any convenient means to facilitate isolation of the polymer.

The initiator may be a persulfate acid or salt such as potassium persulfate, an azo initiator such as azo-bis-(isobutyronitrile), azo-bis(α,α-dimethylvaleronitrile) or azo-bis(α,α-dimethyl-γ-methoxyvaleronitrile) or a peroxide initiator such as t-butyl peroxyneodecanoate or other free radical initiator known in the art.

Low radical concentration is achieved by using a low initiator concentration and operating at low monomer(s)/$H_2O$ ratio and at temperatures as low as consistent with satisfactory conversion and yield. Usually polymerization in emulsion gives whiter, more stable polymer than polymerization in suspension, probably because the polymer accumulates in the non-aqueous phase and thus is insulated from attack by radicals which are formed in the aqueous phase from the water soluble initiator (persulfate). The dodecyl mercaptan or other thiol chain transfer agent serves a dual function. It controls molecular weight by end-capping growing polymer radicals with hydrogen while initiating another chain with the residual RS.radical. Not only is the hydrogen capped end of the first chain stable but also the thioether end of the new chain is highly stable. Thus the second function is to supply a preponderance of stable ends.

The mercaptan chain transfer agent should be essentially insoluble in water. Aliphatic mercaptans having more than 7 carbon atoms are essentially insoluble in water. Dodecyl mercaptan is preferred. Use of an essentially water insoluble mercaptan made available in the polymerization zone by addition of a mutual solvent or an effective emulsifier tends not only to increase the resistance of the polymer to discoloration but also to compensate for the lower polymerization rate entailed by using a low initiator concentration.

Although dodecyl mercaptan is the preferred chain transfer agent, other oil soluble mercaptans including alkyl or aralkyl mercaptans varying in carbon atoms per molecule from 6 to 20 or more may be used. Other nonreactive groups such as hydroxyls, ethers and esters may be present so long as they do not increase water solubility and decrease oil solubility greatly. A final consideration is that the shorter chain mercaptans of $C_8$ or $C_6$ carbon content typically give lower polymer yields than do longer chain mercaptans.

Suitable surfactants should be nonsubstantive on the polymer, i.e., other than cationic if the polymer is designed to be dyeable with cationic dyes. Approximately 5% by weight or less of this surfactant, based on monomers, should efficiently disperse the monomers and chain transfer agent and provide an emulsion of the polymer that is coagulable yet stable to monomer stripping conditions and storage. Preferably, the surfactant should be removable by washing with water. Alkylphenol polyethyleneoxy sodium sulfates having up to 10 ethyleneoxy groups are preferred. The corresponding phosphates are also useful but are more difficult to remove because of lower solubility in hot water. In most instances, at least 0.5% by weight surfactant is required.

The amount of agitation required to produce the acrylic polymers useful in the present invention depends on the composition of the polymerization medium. If a preferred surfactant is present in sufficient quantities to provide a stable emulsion of the polymer, moderate agitation is sufficient. However, more vigorous agitation is required with use of lesser amounts of surfactant or with use of a less efficient surfactant. A deficiency in agitation can be compensated for in part by an increase in mercaptan content. Likewise, increased agitation tends to reduce the amount of mercaptan required to provide a given molecular weight polymer, other factors being constant.

The polymerization preferably is carried out in the range of 25°–65° C. Use of relatively high temperatures increases the rate of polymerization while reducing the molecular weight of the acrylic polymer. Use of relatively low temperatures has the opposite effect. Use of temperatures below about 25° C. results in polymerization rates too low to be commercially useful while temperatures above 65° C. encourage inefficient initiator decomposition and increase side reactions between the initiator and the mercaptan chain transfer agent.

Polymer may be recovered from emulsions by freezing or coagulation of the latex with salts or acids. Preferably, excess monomers first are stripped off under vacuum to prevent further polymerization and to facilitate coagulation. Salts such as sodium chloride, aluminum sulfate or magnesium sulfate and acids such as hydrochloric, sulfuric or phorphoric acids are useful coagulants. After the coagulant is added to the stripped latex, the mixture is heated until the coagulated particles grow large enough to filter easily.

Alternatively, if suitable surfactants are used, the polymerization latex, after removal of unreacted monomers, can be flash extruded into plexifilaments without isolation of the polymer. Suitable surfactants for use in this direct polymerization and flash extrusion process include tridecylpoly(ethyleneoxy)phosphates such as "Gafac" RS 610 and "Gafac" RS 710; the nonylphenoxypoly(ethyleneoxy)sulfates such as "Alipal" EP 110 and "Alipal" EP 120; the nonylphenoxypoly(ethyleneoxy)-phosphates such as "Gafac" RE 410, "Gafac" RE 610, "Gafac" RE 870 and "Gafac" PE 510; and dodecylbenzenesulfonates such as "Ultrawet" 89 LS. One skilled in the emulsifier art will recognize from this partial listing that many more of the commercially available surface-active agents will probably be satisfactory in the process of this invention.

In another modification of the invention, the dyesite and surfactant are combined in the form of a copolymer of acrylonitrile and 2-acrylamido-2-methylpropane sulfonic acid. About 2–3% by weight (based on monomers) of such a copolymer can be used as the surfactant in preparing an acrylonitrile/methyl acrylate copolymer suitable for use in the present invention. The dyesite/emulsifier copolymer becomes intimately and inseparably mixed with the acrylonitrile/methyl acrylate copolymer. The resulting latex has excellent stability and is especially suitable for optional direct flash extrusion without isolation of the polymer.

The process of this invention is a process for producing plexifilament strands which comprises in sequence:

(1) mixing water and an acrylonitrile polymer containing at least 91% by weight acrylonitrile groups and up to 9% by weight copolymeric units having an intrinsic viscosity of 0.6–2.0, 7 to 23 μeq./g. enolizable groups after mild acid treatment, 1.5 to 7.0 μeq./g. thioether ends derived from a water insoluble mercaptan and less than 3 μeq./g. oxidizable hydrolysis fragments to obtain a substantially unform dispersion thereof, the polymer previously having either been isolated and washed or being in the emulsion form as prepared, the concentration of the polymer being between about 25% and 45% by weight based on the total weight of the dispersion, and adding up to 15% of a water-insoluble stabilizer based on polymer, if the polymer has been isolated and washed.

(2) heating the dispersion to a temperature between about 200° C. and about 300° C. but above the melting point of the complex formed by the polymer and water under at least autogeneous pressure, while maintaining the uniformity of dispersion, said heating occurring at a rate to minimize degradation of the polymer, the dispersion being held at least one or two minutes and (3) extruding the dispersion abruptly into a region of substantially lower temperature and pressure.

The dispersion contains substantially molten acrylonitrile polymer complex with water as one phase and water as another phase under at least autogenous pressure at a temperature above the melting point of the acrylonitrile polymer/water-association complex. Use of water-insoluble nucleating agents in unnecessary when starting with a polymer emulsion prepared according to this invention.

If the dispersion is obtained by blending isolated and washed polymer with water in the desired amounts, along with the additives, the ingredients must be mixed well before heating to obtain a substantially uniform dispersion or slurry. A high-speed blender is suitable for this purpose.

Polymer concentration in the dispersion should be between about 25% and about 45% by weight based on the weight of the dispersion. A range of 30–45% is preferred. Above about 45% foam strands begin to be produced, and below about 25% a discontinuous "fly" or "fluff" begins to appear. In addition, when employing the water-insoluble inorganic oxide, its hydrate or salt thereof, it is preferred to use concentrations toward the higher end of their permissible range, e.g., 10–25% by weight based on the weight of the polymer, and preferably 10–15%, because lesser amounts tend to produce foams depending on the temperature and the concentration of polymer.

The temperature at which extrusion occurs and the rate at which the dispersion is heated are important factors. In general, the higher the extrusion temperature, the better the plexifilament strand produced, since the rapid "flashing" of liquid water into its gaseous phase is important to the successful production of the plexifilaments. The temperatures employed will range between about 200° C. and 300° C., with 240° C. to 290° C. preferred. However, the temperatures used, and the length of time taken to heat the dispersion up, both bear on the quality of the dispersion to be extruded, for the polymers in the heated water are susceptible to degradation. To minimize degradation in the continuous production of plexifilaments, the dispersion should be heated as rapidly as possible and should be extruded as soon as possible after reaching the desired extrusion temperature. Typically, time of heating does not exceed about 30 minutes. The temperature, of course, must be at least above the hydration temperature of the polymer used.

The pressure at which the dispersion is to be extruded must be at least autogenous pressure and preferably will range from about 500 to about 1500 psig (~3500–10,350 kPa).

It may sometimes be helpful to maintain the pH of the dispersion on the acidic side. For example, when a 93.8/6/0.1 acrylonitrile/methyl acrylate/sodium styrene sulfonate copolymer is used, the quality of the plexifilament strands produced is enhanced by using dispersions having a pH less than 5; while when a copolymer of 95/5 acrylonitrile/sodium styrene sulfonate is used a pH of less than 2 is desirable. The pH may be adjusted by adding an acid such as glacial acetic acid, sulfuric acid or the like.

The dispersion is maintained at the desired high temperature and pressure, then is abruptly extruded into a region of lower pressure and temperature, usually room temperature and pressure. The abrupt change in temperature and pressure causes the water to "flash", i.e., convert from liquid to gas, rapidly through the extrusion orifice, which in turn causes the formation of the plexifilament strands.

In order to maintain good uniformity of concentration in the dispersion, it is sometimes advantageous to employ a pressure let-down region, i.e., region of slightly reduced pressure, immediately adjacent the extrusion orifice to promote dispersibility just prior to extrusion.

The extrusion rate may range from 2000 yards per minute (ypm) or lower to 15,000 ypm or even higher depending on the pressure, viscosity of the dispersion and the size of the extrusion orifice. The orifice is a single orifice and may range from 0.005 "(0.127 mm) to about 0.1" (2.54 mm) in diameter.

The plexifilament strands produced by the process of this invention comprise a three-dimensional network of interconnected elements called fibrils. Usually the fibrils are less than 1μ in thickness and may be aggregated to larger fibrils of 5μ or less thickness. The fibrils may be thought of as an intermingled non-planar matrix of very thin film or ribbon-like elements that are irregularly interconnected (joined) at various points to form a web-like network or plexus.

The plexifilaments so produced are in the form of continuous strands (or yarns) and are characterized by high surface area, soft tactility and good cover. They are useful in the preparation of textile products, such as fabrics, tapes, ribbons, batts, and the like. Plexifilaments produced by the process of the present invention are water-wettable and rapidly absorb and transport water, thus making them particularly useful in towelling fabric uses.

TEST PROCEDURES

Enolizable Groups

β-ketonitrile groups are believed to be present in all free-radical-produced acrylonitrile polymers. The are formed during polymerization by attack of a radical on a nitrile group in a preformed or growing molecule, giving an enamine group. Subsequent hydrolysis leads to a β-ketonitrile group. The accepted reactions are outlined in both U.S. Pat. No. 3,448,092 and Macromolecules 1, 59 (1968). Such groups exist in two forms, keto and enol, that are in equilibrium with each other:

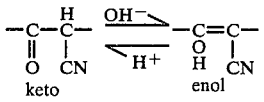

The procedure by which enolizable groups are measured in acrylonitrile polymers or fibers comprises mild acid treatment to insure conversion of all enamine groups to ketonitrile groups and tiration by base, using a UV absorbance maximum found in the range of 270–275 nm as indicator. A faster method is based on UV absorbance alone, once a calibration of the absorbance difference has been done. The procedure is:

1. One gram of 50-mesh or finer polymer (or fiber) is stirred at the boil for one hour in 100 ml. water previously adjusted to 2.0 pH with hydrochloric acid. The mixture is cooled to room temperature and its pH is adjusted to 4 with dilute sodium bicarbonate. The polymer (or fiber) is removed by filtration, washed on the filter with 5 50-ml portions of water and vacuum dried at 50°–60° C. to constant weight.

2. About 0.16 g weighed to the nearest 0.1 mg. of the acidified and dried polymer (or fiber) is dissolved by stirring at room temperature in 40 ml. of a solution of one part propylene carbonate dissolved in three parts (by weight) of ethylene carbonate (EC/PC), the solvent previously having been stirred for about 30 hours in activated carbon and filtered. The solution is acidified to an apparent pH of 0 by addition of about 10 μeq. perchloric acid (0.1 N in methanol). The solution is divided into two 20 ml. portions.

3. One portion of the solution is used to fill a 1-cm cell, retaining the residue, absorbance is measured while scanning on a UV split-beam spectrophotometer from 350 to 250 nm to define exact location and intensity of absorbance at the maximum (in the vicinity of 270 nm). A 20-ml sample of solvent, to which the identical amount of perchloric acid has been added, is used to fill the reference cell, again retaining the residue.

4. To the second portion about 25 μeq. of potassium hydroxide (0.1 N) in ethanol is added to give an apparent pH of about 11; the same amount of base is added to the reference.

5. The absorbance scan is repeated. The difference in absorbance intensities at the maximum is directly related to the amount of enolizable groups in the polymer (or fiber) sample.

6. Calibration of the absorbance in terms of enolizable groups is done by making a series of absorption scans on a solution of about 1.0 g. polymer, weighed to the nearest 0.1 mg., in 50 cc EC/PC, first as described in steps 1–3 above, then (repetitively) after each of several additions of small known amounts of 0.05 N potassium hydroxide in ethanol until the final scan of the solution at an apparent pH of about 11. The absorbance intensities at maximum for the several scans are plotted, as a function of μeq. of base added after correction for dilution by the KOH solution. The straight-line portion of the plot provides the relationship between μeq. of base (and thus μeq. of enolizable groups) and absorbance difference.

Thioether Ends

Thioether end-group content is measured as the difference between strongly acidic, sulfur-containing groups and total combined sulfur. The steps involved are (1) removal of any monomeric, sulfur-containing contaminants, such as occluded dodecylmercaptan and any addition product of the mercaptan and a monomer, (2) dyeing with crystal violet and measuring the equivalents of dye taken up and (3) determination of the total sulfur. The procedure is:

1. 5 g polymer is dissolved in 100 ml DMF by cooling the DMF to 0°–5° C., dispersing the polymer therein and heating with agitation to about 50° C.

2. The solution is poured slowly into the vortex of 450 ml water being rapidly stirred in a blender. About 25 g sodium chloride is added to coagulate (precipitate) any soluble fraction, and stirring is continued for three minutes.

3. The suspension is poured into a beaker and heated to 70° C. It is cooled to about room temperature, filtered and washed on the filter with deionized water until the filtrate is found to develop no silver chloride precipitate on addition of silver nitrate.

4. The polymer is allowed to dry in air, then is ground in a mortar and stirred in 100 ml methanol at 55° C. for 30 minutes. The suspension is filtered; the residue is washed with methanol and vacuum-dried to constant weight.

5. The purified polymer is ground in a "Freezer Mill", using liquid nitrogen as coolant, to pass a 200-mesh screen.

6. About 0.25 g of the ground polymer (weighed to the nearest milligram) is transferred to a vial containing 2.5 mg. sodium acetate, 10 ml. 0.5% aqueous solution of crystal violet and 15 ml. water. The pH is adjusted to 4.5 with 1% acetic acid solution. The vial is capped, the cap secured with Teflon® tape, and the vial heated for 3 hours in a boiling water bath with occasional shaking. The vial is cooled and 5 ml. 10% sodium chloride mixed with the contents.

7. The dyed polymer is filtered off using a Type-A, 1-micron glass filter pad, washed on the filter successively with 50/50 acetic acid/water, water and, finally, ethanol, in each case until the filtrate is colorless. The residue is dried for 20 min. in a vacuum oven at 60° C.

8. About 0.015 g of the dyed, washed and dried polymer is weighed to the nearest 0.0001 g and transferred to a 100-ml volumetric flask. Dimethyl sulfoxide (DMSO) and 2 ml acetic acid are added, and nitrogen blown through until the polymer dissolved. The flask is filled to the mark with DMSO.

9. Absorbancies are measured at once at 690 nm (background) and at the crystal violet peak near 595 nm. The different is net absorbance; from it μeq. strong-acid sulfur (dyesite) is calculated, using a calibration plot of net absorbancies vs. known concentrations of crystal violet, correcting for weight of dye in the sample.

Total sulfur is determined by oxidation of a sample of the purified polymer under conditions that result in conversion of all sulfur to sulfate and titration with barium perchlorate; the steps are:

1. An amount of polymer (generally 250 mg. or less) calculated to contain 0.4–8 mg. sulfur is weighed to the nearest 0.001 g and burned in an oxygen flask to convert all sulfur to trioxide which is absorbed in a sodium carbonate solution previously added to the flask.

The sulfate solution is titrated with standardized barium perchlorate solution using the Thorin Alphazurine Blue end point. The barium solution is prepared by dissolving 0.05 moles barium perchlorate in 200 ml water and adding 800 ml ethanol. The solution is adjusted to an apparent pH within the range of 2.5–4 with dilute perchloric acid and standardized with standardized sulfuric acid, using the same indicator as to be used in the sulfate titration.

Oxidizable Hydrolysis Fragments

Oxidizable hydrolysis fragments are measured by alkaline hydrolysis of a polymer sample and titration with iodine. The procedure is:

1. About 2 g of polymer (or fiber), weighed to the nearest 0.0001 g, is stirred for three hours in 100 ml of 1.5% sodium hydroxide solution under reflux. During this treatment the suspension thickens and discolors, then thins and clears.

2. The resulting solution is cooled to room temperature and acidified to pH 2 with sulfuric acid, which results in a taffy-like precipitate. The mixture is again cooled to room temperature.

3. A starch indicator is added, and the mixture is titrated with 0.02 N iodine solution, using good agitation, until a blue color persists for one minute.

Intrinsic Viscosity is the limit of the natural logarithm of the ratio of the flow time of a dilute solution of a polymer to solvent flow time as the polymer concentration approaches zero. The solvent is a 0.2-molar solution of lithium bromide in dimethylformamide. The temperature at which the measurements are made is 25° C.

Hydrolytic Stability

Polymers of this invention are also characterized by a high resistance to hydrolysis by water at high temperature. This is important to processes such as taught in U.S. Pat. No. 3,984,604—shaping from a single-phase hydrate—and as disclosed in U.S. Pat. No. 3,774,387—shaping of plexifilaments from a dispersion of hydrate.

To measure hydrate stability, samples of finley ground polymer are sealed in glass tubes with ⅓ their weights of water and heated for varying periods of time at 180° C. On termination of its particular period of heating, each tube is cooled in dry ice, and immersed quickly in water; the suspension titrated to determine the amount of ammonia liberated. The onset of hydrolysis is taken as the time in hours at 180° C. for ammonia evolution to amount to 0.05 meq./g polymer.

It is important, of course, to assure the absence of alkaline materials in the polymer to be tested. This can be done by a preliminary treatement as in Step 1 of the above procedure for determining enolizable groups or by treatment with volatile acid such as a dilute solution of acetic acid, followed by thorough rinsing and drying.

Color

Yarn is evaluated for whiteness after winding on a metal card having a 7.6 cm hole in its center. The yarn is wound evenly on the card so as to cover the hole completely. Measurements are made on a Hunterlab Color and Color Difference Meter, Model D-25, using as a standard of comparison a Hunter standard white, MgO plate.

L measures lightness and varies from 100 for perfect white to zero for black, approximately as the eye would evaluate it. The chromaticity dimension a measures redness when plus, gray when zero and greenness when minus, b measures yellowness when plus, gray when zero and blueness when minus.

Whiteness, or "W", values are provided by the D25W module when used with a Model D-25 Hunterlab Color and Color Difference meter. In this measurement, W=4·Blue-3·Green, emphasizing (reading as higher values) the blue reflectance, which correlates with the visual impression of whiteness and deemphasizing (reading as a decrease numerically) the yellowness reflectance. Details of the method for all tristimulus coordinates are given in the D-25 brochure published by Hunter Associates Laboratory, Inc., Fairfax, VA.

DMF Color Stability

In the process of dry spinning, the polymer is dissolved in a volatile organic solvent and extruded into an evaporative atmosphere. One of the preferred solvents is dimethyl formamide (DMF), which will accommodate a practical amount of polymer, but only at relatively high temperatures. Whiteness durability to extended periods of exposure to high temperature in DMF is an important characteristic of a polymer to be spun to fiber. In the test termed herein "DMFCS", a 2% solution of the polymer in DMF is heated under nitrogen for 3 hours at 130° C., cooled, and its absorbance at 425 nm measured. The values reported in the table are absorptivity, calculated as $$\left(\frac{\text{absorbance}}{C \cdot L}\right) \cdot 100,$$

in which absorbance is the difference between that measured on a sample which has not been heated and that measured after heating the solution 3 hours at 130° C., C is the concentration of polymer in the solution in grams/liter and L is the optical length of sample used to measure absorbance. The resultant is arbitrarily multiplied by 100 in order to obtain more convenient values for comparative purposes.

In the following examples, parts and percentages are by weight unless otherwise specified.

POLYMER PREPARATION

I. Polymer According to the Invention

The following illustrates some of the process variations that may be employed in the manufacture of acrylonitrile polymers suitable for use in the present invention.

Tables I and II summarize 9 polymer Runs. In the Tables, AN is acrylonitrile; MA is methyl acrylate; SSS is sodium styrenesulfonate; MMA is methyl methacrylate; AMPS is acrylamido-2-methyl propanesulfonic acid; SSA is styrenesulfonic acid; "Ultrawet 99LS" is a dodecylbenzenesulfonate surfactant sold by ARCO; "Gafac RE 610" is a nonylphenoxypoly(ethyleneoxy) phosphoric acid surfactant sold by G.A.F.: "Alkanol WXN" is a dodecylbenzenesulfonate surfactant sold by Du Pont; PVA is a polyvinyl alcohol; MeCel is methyl cellulose; and LM is lauryl mercaptan (n-dodecylmercaptan).

The process employed for Run I. as described below is generally the same as that employed for Runs II, III, VI and VII. Variations in the preparation of these latter polymers are given in the Tables.

This illustrates the preparation of a copolymer containing 92.2% by weight acrylonitrile, 7.3% by weight methyl acrylate and 0.5% by weight sodium styrenesulfonate.

Water (5976 kg.), sodium dodecylbenzene sulfonate ("Ultrawet" 99LS, 10.8 kg.) and sodium styrenesulfonate (5.26 kg.) are mixed at room temperature in a nitrogen blanketed (pressure=14–34 kPa), glass-lined 7570 liter kettle. The pH is adjusted to 7.1 with NaOH and the mixture heated to 50°–56° C. This is solution (1).

Acrylonitrile (964.8 kg.) and n-dodecylmercaptan (10.4 kg.) are mixed in a nitrogen blanketed kettle similar to that used above. This is solution (2).

Solutions (1) and (2) are blended at the inlet of a centrifugal transfer pump at the rate of 227 l./min. in a volume ratio of 6.3/1, respectively. A second centrifugal pump of smaller capacity than the first is piped backwards into the discharge of the first to provide additional turbulence. The resulting emulsion is fed into a jacketed polymerization reactor of 7570 liters capacity with agitation under a nitrogen blanket of 14 kPa while methyl acrylate (76.2 kg.) is added and the temperature raised to 59.5° C. over a 30 minute period.

The polymerization is initiated by adding an aqueous solution containing 820 g potassium persulfate. Polymerization is continued for five hours at 60°±1° C. The resulting latex is steam stripped at 55°–65° C. and 130–170 mm Hg. absolute to remove unreacted monomer. The latex is cooled to 30°–35° C. and pumped to two 284 liter coagulation vessels in series. Each vessel is equipped with a 20.32 cm, 2.54 cm. pitch propeller for agitation and is blanketed with nitrogen at 172 kPa. The propeller in the first vessel is operated at 1140 rpm and the propeller in the second at 300 rpm. The latex is pumped into the first vessel at 11.4 l/min along with an equal volume of water and 0.4 l/min 0.5% by weight aqueous $MgSO_4$ as coagulant. The coagulum flows from the first vessel to the second vessel where the polymer particles agglomerate to filterable size. The temperature of the first vessel is 70° C. and that of the second is 125° C.

The polymer is removed by filtration and washed and dewatered on a continuous belt filter 45.7 cm. wide and 4 m. long running at 6.4 m/min. Cake forming utilizes 51 cm. of belt length followed by two washing zones 61 cm in length and a steaming zone 76 cm in length. The final 1.5 m. of length is used for dewatering to a polymer content of 26%. 2380 parts by weight water at 95° C. and 35.7 parts by weight steam are used per 100 parts by weight of polymer. 27.2 kg./hour steam at atmospheric pressure is used for steaming.

The polymer is dried batch-wise to less than 2% by weight moisture in a rotating, double-cone vacuum dryer at first jacketed with 76°–88° C. water and then with 14–21 kPa steam in the later stages.

Preparation of polymers IV and VIII is closely analogous. The description following is of the preparation of polymer IV. Variations in polymer VIII and its preparation are given in the Table.

This example illustrates continuous emulsion polymerization.

The apparatus used includes two reactors in series. The overflow from the first reactor flows into the second reactor. Both reactors are continuously fed reagents, as detailed below, and the polymer emulsion overflows continuously from the second reactor. Both reactors are equipped with 4 approximately 2-cm vertical indentations or ribs to damp swirling and enhance mixing and have jackets for water heating and cooling. Working capacities of the first and second reactors are 2.4 l and 12.8 l, respectively.

Feeds for the first reactor are emulsified in a first premixer which consists of a 500 cc 3-neck flask equipped with a stirrer having four blades 1 inch (2.54 cm) long and 0.25 inch (0.64 cm) wide operating at 2300 rpm. Feeds for the second reactor consist of the overflow from the first reactor and additional feeds, as detailed below, emulsified in a second premixer which consists of a 1000 cc, 3-neck flask equipped with a stirrer similar to that of the first premixer. The entire system is maintained under a nitrogen blanket.

The reactors are swept well with nitrogen, charged with the following ingredients just prior to start up and heated to about 65° C. by circulation of hot water in the jackets of the reactors.

| | Prefeed to Reactors | |
|---|---|---|
| | 1st Reactor | 2nd Reactor |
| Water | 1200 g | 6400 g |
| $K_2S_2O_8$ | 0.30 g | 2.23 g |
| Emulsifier-nonyl phenol Poly(ethylene oxy) phosphate ("Gafac" RE610) | 12.05 g | 45.6 g |
| pH(adj. with $NH_4OH$) | 5.2 | 4.15 |

At startup, the following continuous feeds are begun to the inlets of the first and second premixers, respectively, which previously had been half filled with the same compositions less monomers and initiator:

| | Feed rates per minute | |
|---|---|---|
| | 1st Premixer | 2nd Premixer |
| Acrylonitrile (AN) | 15.64 g | 22.54 g |

-continued

| | Feed rates per minute | | | |
|---|---|---|---|---|
| | 1st Premixer | | 2nd Premixer | |
| Methyl acrylate (MA) | 1.34 g | | 2.01 g | |
| dodecylmercaptan | 0.064 g | (with AN) | 0.143 g | (with AN) |
| sodium styrenesulfonate | 0.085 g | (as 27 cc aqueous) | 0.133 g | (as 10.9 cc) |
| Gafac RE610 | 0.572 g | | 0.186 g | |
| $K_2S_2O_8$ | 0.02 g | (as 5 cc aqueous) | 0.019 g | (as (1.55 cc aqueous) |
| Water | 4.3 g | | 6.36 g | |

With these feed rates, holdup in reactor 1 is about 42 min. Holdup in reactor 2 is about 120 min. After start of the polymerization, reaction temperatures are maintained at 65±°0.5° C. by controlling the temperature of cooling water fed to the jackets.

Periodic samples of the emulsion that continuously overflows from the second reactor are coagulated at once, and the polymer removed by filtration washed, dried and weighed to determine conversion rate.

The overflowing emulsion from the second reactor is stripped to a monomer content of 120 ppm or less by first gently agitating while evacuating to a pressure of about 660 mm Hg, diluting with water to about 36% polymer content and countercurrent stripping in a packed column with steam.

Characterization data in Table II for this polymer were derived from plexifilaments produced according to Example I.

V. Conventional Redox Polymer

The two items described under this heading in Tables I and II were made in a commercial-scale, priorart, redox, slurry polymerization process such as taught in U.S. Pat. No. 2,837,501, and are included as comparisons.

Semi-dull (0.4% $TiO_2$ delusterant) yarns made by art-known dry spinning process from polymers II, III, V-A, V-B and VI–VIII were knitted and the fabrics boiled for one hour in 0.1% NaOH solution to simulate the discoloration effect of severe commercial laundering. After thorough rinsing and drying, they exhibited yellowness corresponding to the "b" values in Table II. Enolizable groups content of the polymers are also included in Table II and a comparison between these values for the various polymers illustrates the correlation between them. Other characterization data in the table which in general correlate with enolizable group content are hydrolytic stability (HS) and DMF color stability (DMFCS); the latter is a measure of whiteness stability on exposure of a solution to high temperature.

It is apparent from the tabulated data that the polymers and the fibers made from them by the process of this invention are superior in whiteness not only initially but after use. The data in the "Simulated Severe Laundering" column illustrate the durability-of-whiteness advantage for several of the polymers useful in practice of the invention in comparison with two prior art polymers. Although such data are not available to illustrate adequacy of some of the tabulated polymers in this respect, it is the inventor's belief that all polymers within the scope of the characterizing limitations as described herein possess these advantages.

DMFCS, while of more practical concern in the manufacture of fiber of good initial whiteness, nonetheless reflects the advantage of improved whiteness durability of polymer during the high-temperature exposure involved in shaping.

EXAMPLE I

The latex of Run IV containing 35.2% polymer was diluted with water to contain 32% polymer. The pH of the latex is 6.1. The latex is pumped through a 29 meter long tubular heater whereby the latex achieves a temperature 100° C. within the first two meters. The temperature of the latex is increased smoothly to 275° C. during travel through the remaining 27 meters of the heater. The internal diameter of the heater is 0.62 cm for the first third of its length and 0.77 cm. for the final two thirds of its length. The hot fluid which is now an aqueous suspension of melted polymer hydrate is filtered through a 100 mesh screen and passed through a pressure let-down orifice 0.66 mm. in diameter by 1.02 mm. long into a let-down chamber packed with Kenics static mixers. The let-down chamber has two sections, the first section is 0.635 cm. in diameter by 24.1 cm. long and the second section is 0.476 cm. in diameter by 43.2 cm. long. From the let-down chamber the mixture is passed through a filter pack consisting of 7 50-mesh, 9 20-mesh and 1 80-mesh screens to a three hole spinneret having holes 0.254 mm in diameter by 0.457 mm in length. An outwardly tapering shroud 0.38 cm. in length and reaching a diameter of 0.3 cm. at its discharge end is oriented around the three holes. The pressure of the mixture is 8480 kPa before the let-down orifice and 6000–6410 kPa at the spinneret. Residence time of the polymer/hydrate suspension in the system from beginning of heating until spinning is estimated to be two minutes.

An aqueous suspension of the polymer of Run V B containing 32% by weight finely ground polymer and 4% Kaopaque® 10 (a finely divided kaolin) is continuously agitated and then processed as above.

The properties of the plexifilaments obtained in these two flash spins are as follows:

| | Polymer | |
|---|---|---|
| | Run IV | Run V-B |
| Color: L | 97 | 96 |
| a | −0.2 | −0.2 |
| b | 3.0 | 4.3 |
| W | 77 | 68 |
| Tex | 21.1 | 17.5 |
| Tenacity, mN/tex | 107 | 72 |
| Elongation, % | 36 | 13 |

EXAMPLE II

This example illustrates the improved hydrolytic stability of the acrylic polymers useful in the present invention.

The polymer tested is the polymer of Run III and the control polymer is a polymer similar to the polymer of Run V-A. The procedure is as follows:

1. Thirty grams of finely ground polymer is thoroughly mixed with 7.7 g water and 2 g tetramethylene sulfone at room temperature.

2. The mixture, which appears to be a dry powder, is transferred to a heavy walled cylinder equipped with one screen having about 20 wires/cm. and two screens having about 79 wires/cm. and a spinneret with a single hole 0.25 mm in both diameter and length.

3. A closely fitting, Teflon ®-gasketed, free piston is inserted. The spinneret is closed by pressing a Teflon ® pad against its outer face.

4. The cylinder is cooled to −10° C. and evacuated via a valved side port between the piston and the spinneret to a pressure corresponding to the water vapor pressure at that temperature. The sideport is closed.

5. The cylinder is heated to 180° C. pressured with about 3500–4100 pKa (500–600 psig) nitrogen applied to the piston and held under these conditions for the time noted below.

6. The pad is removed from the spinneret face to permit emergence of a filament.

The polymer of Run III is held at 180° C. for seven hours. Upon removing the pad, a filament emerges, part of which is wound up and analyzed for whiteness as described in Example 1. Found: 86L, 0.8a, +7.9b, 35W. The filament appears white.

The polymer similar to the polymer of Run V-A is held at 180° for three hours. Upon removal of the pad from the spinneret, a foam strand emerges for a short time, but no solid filament is obtained even after strong quenching. The cylinder is cooled while under pressure. The polymer plug remaining in the cylinder is uniformly deep orange in color and has a foul odor including a strong smell of ammonia, suggesting severe polymer degradation and crosslinking during the three hours holding of the hydrate at 180° C., in contrast with the spinnability of the hydrate from the polymer of Run III even after 7 hours at 180° C.

TABLE I

| Run No. | Emulsifier (% on Monomer) | Initiator (% on Monomer) | T/React. Time °C./hrs. | Chain Terminator (% on Monomer) |
|---|---|---|---|---|
| I | Ultrawet 99LS (1) | $K_2S_2O_8$ (0.08) | 60/5 | LM (1.01) |
| II | "Alkanol" WXN (3) | $K_2S_2O_8$ (0.15) | 60–70/3 | LM (0.86) |
| III | Gafac RE610 (4) | $K_2S_2O_8$ (0.1) | 67/0.5 | LM (0.7) |
| IV | Gafac RE610 (1.8) | $K_2S_2O_8$ (0.09) | 65°/2 | LM (0.5) |
| V-A. V-B | None | $K_2S_2O_8$ $NaHSO_3$ .31/2.5 | 60/62 min. | none |
| VI | Gafac RE610 (2.5) | $K_2S_2O_8$ (.031) | 60/5 | LM (0.94) |
| VII | PVA (0.26) Methocel(0.38) | Vazo ® 52 (0.25) | 60/3 | LM (1.26) |
| VIII | Gafac RE610 (3) | $K_2S_2O_8$ (0.2) | 65/1.5 | LM (0.7) |

| Run No. | Conversion (%) | Polymerization Type |
|---|---|---|
| I | 75 | Batch |
| II | 65 | Batch |
| III | 30 | Continuous |
| IV | 83 | Continuous |
| V-A | 80 | Continuous |
| V-B | 78 | |
| VI | 80 | Batch |
| VII | 78 | Batch |
| VIII | 86 | Continuous |

TABLE II

| Run No. | Polymer Feed Comp. (%) | [η] | EG (μeq/g) | TE (μeq/g) | OHF (μeq/g) |
|---|---|---|---|---|---|
| I | AN/MA/SSS (92.2/7.3/0.5) | 0.93 | 16 | 45 | 1.8 |
| II | AN (100) | 1.5 | 9 | 50 | 1 |
| III | AN/MA/SSS (93.7/5.6/0.7) | 1.0 | 19 | 34 | 1 |
| IV | AN/MA/SSS 91.5/8.0/0.5 | 1.32 | 14 | 18 | 1.5 |
| V-A | AN/MA/SSS | 1.0 | 35 | none | 18 |
| V-B | 93.9/6/0.1 | 1.4 | 27 | none | 17 |
| VI | AN/MA/SSS 91.3/8/0.7 | 0.96 | 14 | 44 | 1.5 |
| VII | AN/MA/t-BuA-SS 90.7/7.8/1.5 (91.3/7.9/0.8) | 0.82 | 11 | 61 | 1 |
| VIII | AN/MA/SSS | 1.1 | 17 | 30 | 1 |

| Run No. | HS (hrs.) | Fiber Whiteness (boiled off) (b/L/W) | DMFCS | Simulated Sever Laundering "b" |
|---|---|---|---|---|
| I | 7 | 2.2/85/62 | .12 | |
| II | 9.2 | −0.2/86/74 | .07 | 3 |
| III | 6.4 | — | — | — |
| IV | 6.5 | 3.0/97/77 5/87/48 | | |
| V-A. | 3.5 | 5.7/94/56 | .83 | 13.1 |
| V-B. | 4.5 | 5.7/94/56 | .35 | 7.8 |
| VI | 7 | 1.6/94/50 | .13 | 1.9 |
| VII | 6.5 | 3.1/90/65 | — | — |
| VIII | 8 | 2.3/95/78 | .14 | 1.8 |

*As sodium salt of SSA; made as the triamylamine salt; becomes the sodium salt on scouring.

I claim:

1. Process for producing plexifilament strands of an acrylonitrile polymer which comprises dispersing in water 25 to 45% by weight of an acrylonitrile polymer containing at least 91% by weight acrylonitrile units and up to 9% by weight copolymeric units having an intrinsic viscosity of 0.6 to 2.0, 7 to 23 μeq./g. enolizable groups after mild acid treatment, 15 to 70 μeq./g. thioether ends derived from a water insoluble mercaptan and less than 3 μeq./g. oxidizable hydrolysis fragments, heating the dispersion to a temperature of 200° to 300° C. while maintaining the dispersion under sufficient pressure to maintain the water in the liquid state, the time of such heating not exceeding about 30 minutes, and promptly flash-extruding the dispersion through an orifice into a region of substantially lower temperature and pressure to form a continuous strand of fibrillated plexifilaments.

2. Process of claim 1 wherein the intrinsic viscosity is 0.8 to 1.5.

3. Process of claim 1 wherein the intrinsic viscosity is 0.9 to 1.1.

* * * * *